United States Patent [19]

Tappert et al.

[11] 4,351,237

[45] Sep. 28, 1982

[54] DEVICE FOR PRINTING-PRESSURE CONTROL

[75] Inventors: Hans-Jürgen Tappert, Coswig; Horst Schulz, Dresden; Hans Johne, Radebeul; Albrecht Johne, Dresden, all of German Democratic Rep.

[73] Assignee: Veb Kombinat Polygraph "Werner Lamberz" Leipzig, Leipzig, German Democratic Rep.

[21] Appl. No.: 129,886

[22] Filed: Jun. 5, 1980

[30] Foreign Application Priority Data

Mar. 26, 1979 [DD] German Democratic Rep. ... 211779

[51] Int. Cl.[3] ..... B41F 13/34

[52] U.S. Cl. ..... 101/216; 101/153; 100/47; 73/862.44

[58] Field of Search ..... 101/216; 308/37; 100/47; 73/862.44, 862.45

[56] References Cited

U.S. PATENT DOCUMENTS

| | | | |
|---|---|---|---|
| 3,331,313 | 7/1967 | Notbohm et al. | 100/47 |
| 3,600,747 | 8/1971 | McCarty | 100/47 |
| 3,732,813 | 5/1973 | Vir Singh et al. | 101/216 |
| 3,900,812 | 8/1975 | Brewer | 73/862.55 |
| 3,965,735 | 6/1976 | Hartung | 101/216 |
| 4,033,260 | 7/1977 | Lein et al. | 101/232 |
| 4,112,751 | 9/1978 | Grunbaum | 73/862.54 |
| 4,117,719 | 10/1978 | Schutz | 73/862.54 |
| 4,203,319 | 5/1980 | Lechler | 73/862.54 |

FOREIGN PATENT DOCUMENTS

| | | | |
|---|---|---|---|
| 23541 | 2/1981 | European Pat. Off. | 101/153 |
| 23542 | 2/1981 | European Pat. Off. | 101/153 |
| 1042923 | 11/1958 | Fed. Rep. of Germany | 101/216 |
| 1944446 | 3/1971 | Fed. Rep. of Germany | 101/216 |
| 1411327 | 9/1972 | Fed. Rep. of Germany | 101/216 |
| 2300946 | 7/1974 | Fed. Rep. of Germany | 101/216 |
| 1502229 | 11/1967 | France | 101/216 |
| 149871 | 8/1962 | U.S.S.R. | 100/47 |
| 651075 | 3/1979 | U.S.S.R. | 100/47 |

*Primary Examiner*—William Pieprz

*Attorney, Agent, or Firm*—Michael J. Striker

[57] ABSTRACT

A pressure control arrangement for controlling pressure between a printing roller and an offset roller by measuring a force exerted in a bearing of the printing roller when the latter rotates with an angle $\psi$. The arrangement includes a piezoelectric pickup positioned on the internal surface of the bearing of the printing roller, a measured pressure value processor for receiving a signal from the piezoelectric pickup, an indicator generating a signal corresponding to a desired pressure value and means to compare the first abovementioned signal with the second mentioned signal. The arrangement also includes a positioner circuit which receives the compared signal and applies the same to a drive member which adjusts the position of the bearing of the offset roller thereby adjusting printing pressure between two contacting rollers for printing on sheets of paper.

10 Claims, 5 Drawing Figures

DEVICE FOR PRINTING-PRESSURE CONTROL

BACKGROUND OF THE INVENTION

The invention relates to a device for printing-pressure control in printing presses.

Devices are known for setting the printing pressure between an offset cylinder and printing cylinder so that a print of requisite quality will be obtained. One of the conventional devices has been disclosed in the German Pat. No. DE 1561071. In the foregoing device, the printing pressure is set by means of a first hydraulic cylinder acting via a toggle-lever mechanism upon the cylinders. A second hydraulic cylinder is provided is the known device as the adjustable cylinder. If the axial distance between the cylinders of the printing press changes beyond an adjustable dimension, pressure in the second hydraulic cylinder will rise and a pressure regulator arranged in the hydraulic supply line connected to the second hydraulic cylinder will interrupt the oil supply to the first hydraulic cylinder. This arrangement serves as the overload protection.

This device will only allow setting of the printing pressure but not regulating the printing pressure. The control of the printing pressure which has been set according to the operator's feeling can only be effected by controlling the results of printing and this will result in waste paper or in the fact that not all prints will be commensurate with the quality requirements.

SUMMARY OF THE INVENTION

It is an object of the invention to improve printing results by an exact regulation of the printing pressure between cylinders in printing presses.

It is also an object of the invention to provide a device for controlling the printing pressure in relation to the actual printing pressure prevailing when the printing press is prepared and then operated.

As per invention, these and other objects are attained by a device for controlling the printing pressure between two cylinders in printing presses, provided with a pressure sensor and a circuit arrangement for signal evaluation which has a piezoelectric pickup arranged in the central line of effect of the bearing pressure in a printing cylinder bearing, and, which has arranged, subsequent to the pickup, a processor for the measured values with a discriminator for comparing the desired value with the actual value and a positioner for adjusting a printing cylinder bearing.

The invention is described in detail below with the aid of an embodiment.

DETAILED DESCRIPTION OF THE INVENTION

Figure 1:
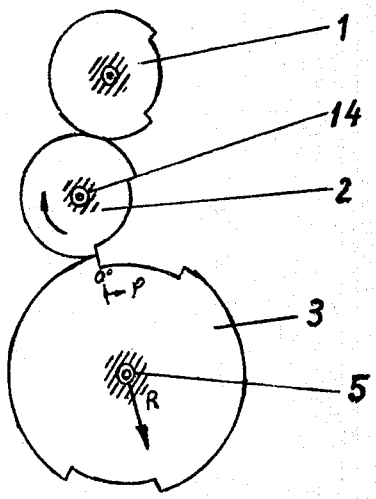
FIG. 1 is a schematic view of the cylinders in a printing press.

FIG. 1 shows an arrangement including plate feeding cylinder or roller 1, offset cylinder or roller 2 and an printing cylinder or roller 3 in a printing press. A bearing force R will occur in a printing cylinder bearing 5 resulting from the weights of plate cylinder 1, offset cylinder 2 and printing cylinder 3, and from the pressure between plate cylinder 1 and offset cylinder 2 as well as between offset cylinder 2 and printing cylinder 3. This bearing force R is a function of the angle of rotating $\phi$ of the printing cylinder 3 as may be seen in FIG. 2. Variations of the bearing force R result from the mutual spatial relation of the surfaces of plate cylinder 1, offset cylinder 2 and printing cylinder 3 relative to the angle of rotation $\phi$. The bearing force R is a measure for the printing pressure, i.e. for area load exerted between offset cylinder 2 and printing cylinder 3.

Figure 3:
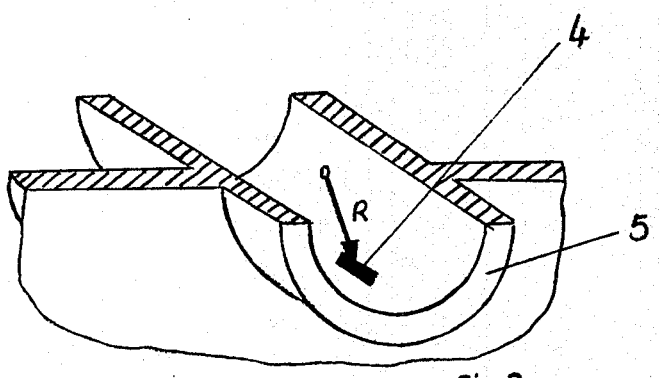
FIG. 3 is a partial perspective view, partially in section of an arrangement of a sensor mounted in printing cylinder bearing.
Figure 4:
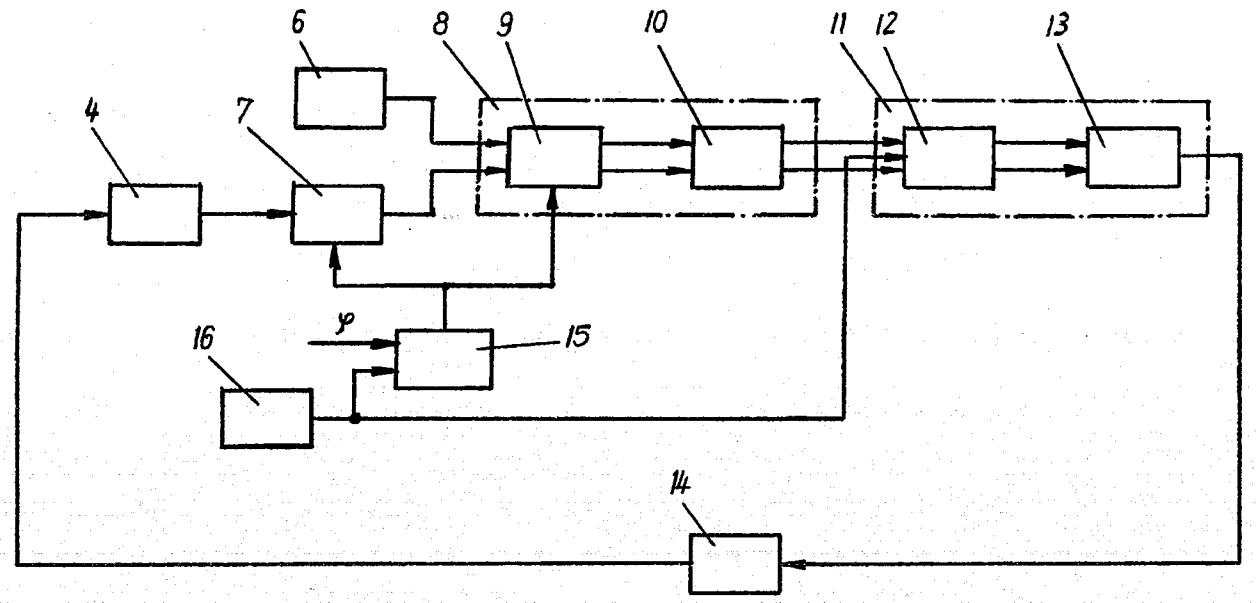
FIG. 4 is a schematic view of printing pressure control arrangement.

The bearing force R in the printing cylinder bearing 5 is picked up by a pressure sensor 4 which may be, for instance, a piezoelectric pickup, arranged in the central line of effect of the force R as seen in FIG. 3. The system described, using the example for offset cylinder/-printing cylinder may also be used for the system plate cylinder/offset cylinder and also for the system including plate cylinder/printing cylinder. The printing pressure control arrangement illustrated in the diagram shown in FIG. 4, serves for the further processing of the signals received from the pressure sensor 4. The control arrangement also performs the task of measuring pulses during maximum printing pressure, further processing of measured values, and controlling the printing pressure. The purpose of the control lies in setting of the correct printing pressure by adjusting the eccentric bearing of offset cylinder 2 when the press is set up and then operated. The device for printing pressure control (FIG. 4), consists of the pressure sensor 4 connected to a measured-value processor 7 and a discriminator 9 arranged subsequent to the processor 7. An indicator for the desired value 6, serving for comparing the desired and actual values with each other is connected to the discriminators 9 of a printing pressure control circuit generally denoted as 8. The measured-value processor 7, and the discriminator 9 are controlled by a pulse generator 15 which receives a signal corresponding to the angle of rotation $\phi$ of the printing cylinder and a signal from a sheet-feed control 16. The outputs of the discriminator 9 are led to a memory circuit 10 appurtenant to the printing pressure control 8. The memory circuit 10 is connected to a positioner 11 circuit 11 controlled by the memory. The positioner 11 consists of an amplifier 12 and a drive 13. The amplifier 12 is controlled by the sheet-feed control 16. The drive 13 is operatively connected to an offset cylinder bearing 14 and acts upon the eccentric thereof.

Figure 5:
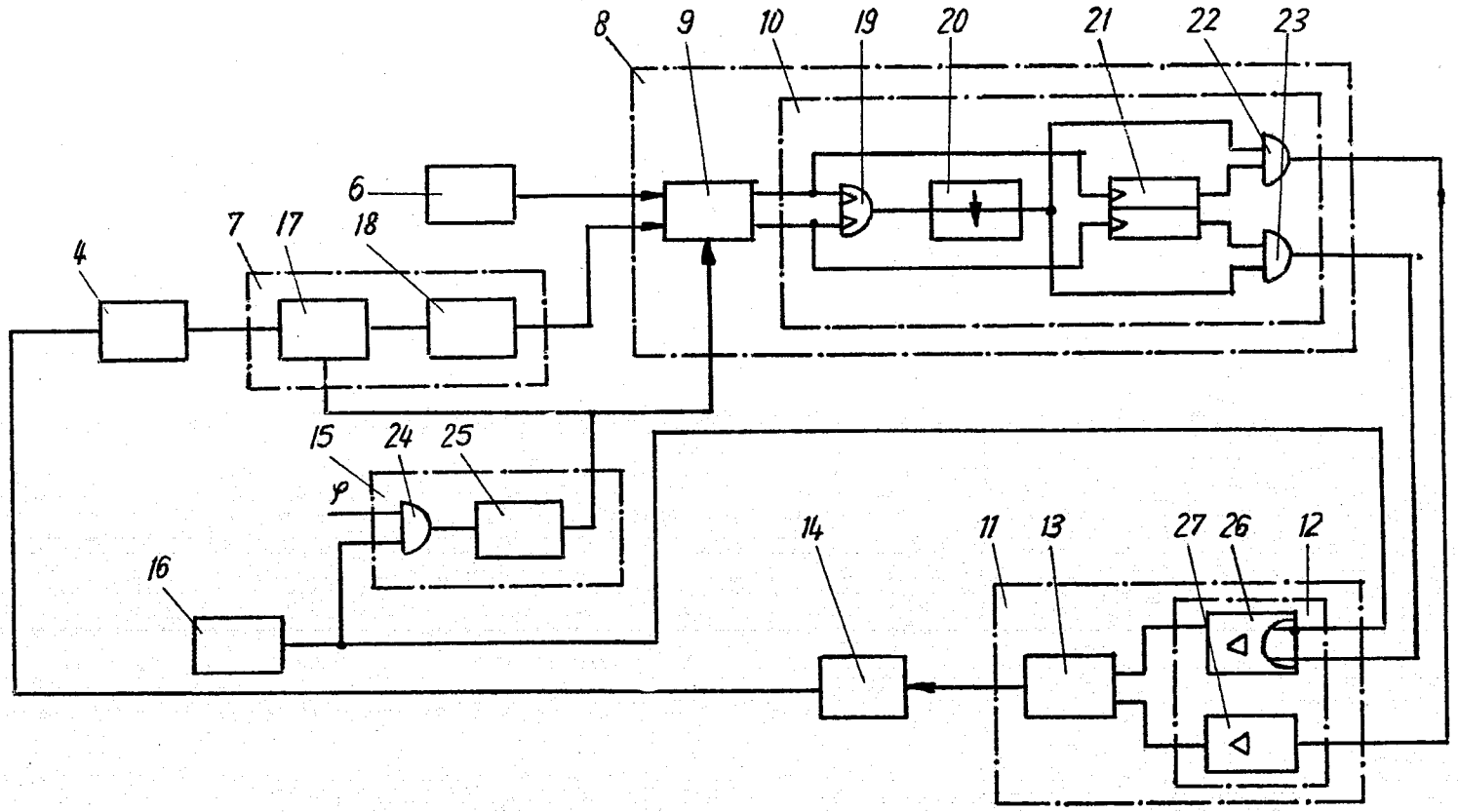
FIG. 5 is a schematic view of another embodiment of printing pressure control arrangement.

FIG. 5 shows another embodiment of a printing pressure control device. The device consists of a pressure sensor 4 mounted on the bearing of the printing cylinder and connected to a measured-value processor 7. The measured-value processor 7 contains a measured-value memory circuit 17 controlled by a gate pulse generator 15, and a measured-value amplifier 18. The discriminator 9 of the printing pressure control circuit 8 is connected to the outputs of the measured-value amplifier 18 and to the desired-value source 6, and is controlled by the gating pulse generator 15. The memory circuit 10 having in-line components, such as differentiator 19, timing unit 20, binary storage 21, first AND gate 22 and second AND gate 23, is arranged subordinate to the discriminator 9. The outputs of the memory circuit 10 are led to the positioner circuit 11.

The amplifier 12 with a first power amplifier 26 and a second power amplifier 27, as well as the drive 13, are arranged in the positioner circuit 11. The first power amplifier 26 is connected to the pulse generator 15. The pulse generator 15 comprises a third AND gate 24 and a control unit 25. The output of the positioner circuit 11 is led to the offset cylinder bearing 14, the adjustment of which will change the printing pressure which is determined by means of the pressure sensor 4.

Figure 2:
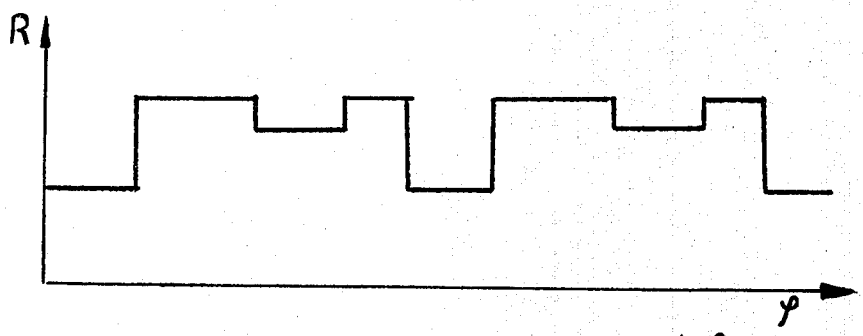
FIG. 2 is a diagrammatic view showing the principle of the translation of bearing force in the printing cylinder bearing.

Functioning of the device as per invention is as follows:

A bearing force R, being a measure of the printing pressure between offset cylinder 2 and printing cylinder 3 will occur in the printing cylinder bearing 5 due to the effect of plate cylinder 1, offset cylinder 2 and printing cylinder 3, as described in FIGS. 1 to 3. This bearing force R is measured by the pressure sensor 4, FIG. 4, which preferably is a sufficiently known, piezo-electric pickup. The output signal of the pressure sensor 4 is applied to a measured-value processor 7. Connecting the measured-values processor 7 to the pulse generator 15 will enable picking up the measured-value contingent upon the angle of rotation $\psi$, this picking up being effected, however only within the range of maximum bearing force R, i.e. the maximum printing pressure, (FIG. 2). For this purpose, the pulse generator 15 will receive a signal proportional to the angle of rotation $\phi$ of the printing cylinder 3 which will control the measuring sequence conjointly with a signal from the sheet-feed control arrangement 16. The output signal of the measured-value processor 7 is compared in the discriminator 9 of the printing pressure 7 is compared in the discriminator 9 of the printing pressure control circuit 8 with the signal received from the desired-value indicator 6, this comparison ensuing in pulses controlled by the pulse generator 15. A pulse-pickup system effects herein a comparison of desired values with actual values. The discriminator 9, of known design, will operate herein as a two-point member with zero position, i.e. it will supply two output signals (increased printing pressure and reduced printing pressure) relative to the zero position. These two output signals are separately stored in the memory circuit 10 according to their significance.

The output signals of the printing pressure control circuit 8 are amplified in the positioner circuit 11 by the amplifier 12 and are then applied to the drive 13. The drive 13 will effect an adjustment of the offset cylinder 14, thus changing the printing pressure as measured by the pressure sensor 4.

FIG. 5 shows a second embodiment for printing pressure control arrangement. Conforming to pulses from the pulse generator 15, the signal picked up by the pressure sensor 4 is first stored in the measured-value memory circuit 17 and subsequently amplified in the measured-value amplifier 18 for further signal processing. The storage of the measured value in the measured-value memory circuit 17 is made in order to have available, through the entire angle of rotation $\phi$, a measured value that can be picked up only within the range of the maximum printing pressure. A comparison of the measured value signal (actual value) with the desired value signal received from the desired-value source 6 is made by the discriminator 9 of known construction, arranged within the printing pressure control arrangement. The desired value may be adjusted manually or automatically. The discriminator 9 will apply two output signals (increased printing pressure and reduced printing pressure) relative to the zero position and operates as a pulse-pickup system controlled by the pulse generator 15. The pulse generator 15 will receive from the sheet-feed control 16 a signal for the angle of rotation $\phi$ and for the sheet-feed, interconnected at the third AND gate 24, and from the control unit 25 operating as an amplifier.

The output signals of the discriminator 9 are differentiated in the differentiator 19 in order to recognize signal changes. Signal changes will effect setting of the timing unit 20 to a predetermined positioning time in the positioner circuit 11. The respective output signal of the discriminator 9 is separately stored in the binary storage 21 according to its significance. During the running time of the timing unit 20, the output signal serves to affect the positioner circuit 11 over the first AND gate 22 or, respectively, the second AND gate 23. Driving of the drive 13 will ensue over the first power amplifier 26, or respectively, the second power amplifier 27. The first power amplifier 26 is connected to the sheet-feed control 16. The latter will effect a retraction of the printing pressure upon interruption of the sheet feed. The drive 13 of the positioner circuit 11 will change the position of the eccentric of the offset-cylinder bearing 14 which, in turn, will change the printing pressure measured by the pressure sensor 4.

It will be understood that each of the elements described above, or two or more together, may also find a useful application in other types of control arrangements for controlling printing pressure, differing from the types described above.

While the invention has been illustrated and described as embodied in a control arrangement for controlling printing pressure, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a printing press having a feeding roller, an offset roller and a printing roller, said offset roller being positioned in contact with said printing roller and with said feeding roller for printing on sheets being processed, each of said rollers being provided with a bearing, and feed-control means, a control arrangement for controlling printing pressure between two of said contacting rollers comprising a sensor for measuring a bearing pressure exerted within a first bearing of one of said rollers, said pressure varying in dependence upon the angle of rotation of said one roller, said sensor being positioned on said first bearing and extending in a plane passing through the central effective line of said force; a measured pressure value processor electrically connected to said sensor to receive a signal corresponding to the measured pressure value therefrom; an indicator of a desired pressure-value to generate a signal corresponding to said desired pressure value; means for comparing said signal of the measured pressure-value with the signal of the desired pressure-value; and positioning means electrically connected to said comparing means and to a second bearing of a second one of said contacting rollers, said positioning means being operative for receiving a compared signal from said comparing means and positioning said second bearing of said second roller in dependence upon the said angle of rotation and in response to said compared signal thereby adjusting the printing pressure between two rollers arranged in contact with each other.

2. The arrangement of claim 1, wherein said sensor is a piezoelectric pickup.

3. The arrangement of claim 2, wherein said comparing means include a discriminator and a memory circuit.

4. The arrangement of claim 3, wherein said positioning means include at least one amplifier and a drive, said drive being operatively connected to said second bearing of said second roller.

5. The arrangement of claim 4, further including a pulse generator electrically connected to said measured-value processor and operative to receive a signal corresponding to said angle of rotation of said one roller.

6. The arrangement of claim 5, wherein said pulse generator is operatively connected to said feed-control means.

7. The arrangement of claim 6, wherein said one roller is said printing roller and said second roller is said offset roller.

8. The arrangement of claim 7, wherein said memory circuit includes a differentiator, a timing unit, a binary storage, and a first AND-gate and a second AND-gate, said first and second AND-gates being electrically connected to said positioning means.

9. The arrangement of claim 8, wherein said positioning means include two amplifiers, the inputs of said two amplifiers being connected to the outputs of said first AND-gate and said second AND-gate, respectively.

10. The arrangement of claim 9, wherein said pulse generator includes a third AND-gate and a control unit, said third AND-gate being electrically connected to said feed-control means.

* * * * *